United States Patent [19]

Wade

[11] Patent Number: 4,726,593

[45] Date of Patent: Feb. 23, 1988

[54] PORTABLE TARGET ASSEMBLY

[76] Inventor: George F. Wade, 5770 Southwest 38 St., Davie, Fla. 33314

[21] Appl. No.: 897,502

[22] Filed: Aug. 18, 1986

[51] Int. Cl.[4] ..... F41J 1/10; F41J 7/00

[52] U.S. Cl. ..... 273/392; 273/407

[58] Field of Search ..... 273/386, 390, 391, 392, 273/407, 409

[56] References Cited

U.S. PATENT DOCUMENTS

| | | | |
|---|---|---|---|
| 2,133,552 | 10/1938 | Long . | |
| 2,777,695 | 1/1957 | Cohn | 273/391 X |
| 3,355,174 | 11/1964 | Hutson . | |
| 3,411,784 | 11/1968 | Lawrence . | |
| 3,415,519 | 12/1968 | Hand | 273/407 |
| 3,647,214 | 3/1972 | Hohmann . | |

*Primary Examiner*—Anton O. Oechsle
*Attorney, Agent, or Firm*—Lyon & Lyon

[57] ABSTRACT

A target assembly having a fixed target mounted above a self-resetting, swingable target with both targets conforming to standard or regulation targets used in shooting competitions. The fixed target, which preferably includes a group of bulls-eye targets, is mounted between vertical posts on a cross member from which the swingable target is pivotally suspended. The swingable target is preferably a silhouette steel plate, and it is positioned on the cross member between pipe spacers which also serve to deflect bullets striking the silhouette target away from the bulls-eye target. The posts are founded on a base assembly and after disassembly may be nested and stored with the cross member in a base member.

19 Claims, 1 Drawing Figure

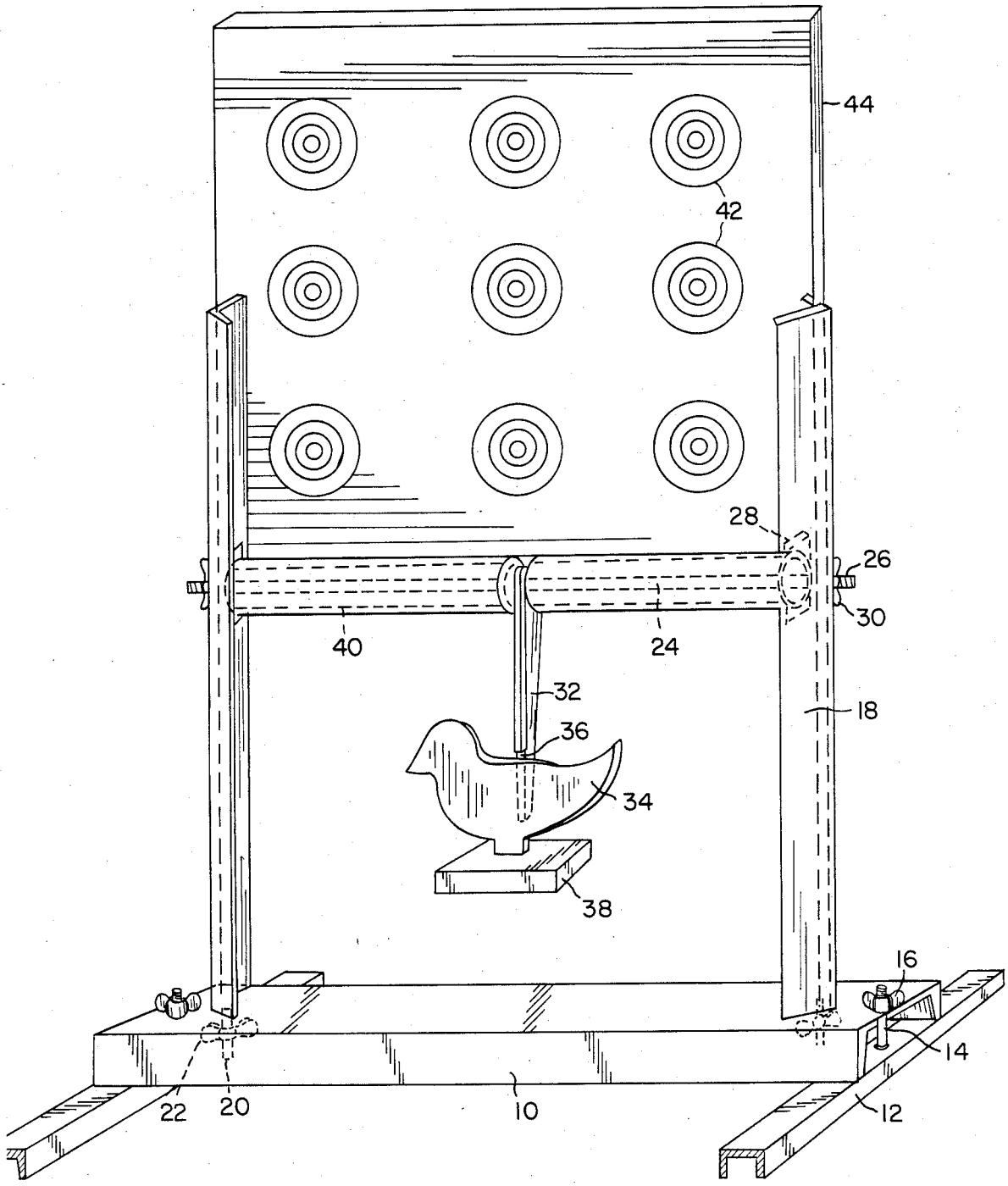
44
42
28
26
30
40
24
32
18
36
34
38
16
14
22
20
10
12

PORTABLE TARGET ASSEMBLY

OBJECTS OF THE INVENTION

The present invention generally relates to shooting targets and more specifically to a novel and improved target assembly to be used preferably for .22 caliber rimfire firearms.

An object of the present invention is to provide a novel and improved target assembly that includes two different types of targets, and without the aid of tools, may be easily assembled for use and disassembled for storage into a compact, relatively lightweight, portable body. Included herein is such a target assembly which may present to the shooter at the same time, fixed bulls-eye targets and a swingable, self-resetting silhouette target which conform to competition or tournament targets sanctioned by rifle clubs or associations such as, for example, the National Rifle Association, hereinafter referred to as the NRA.

Another object of the present invention is to provide a novel target assembly that will present to a shooter at the same time, different types of targets enabling the shooter to fire an entire practice round without having to leave the firing line, to reset or change targets.

Another object of the present invention is to provide a novel and improved target assembly that may be used to advantage by a serious target shooter in practicing for regulation tournaments sponsored by rifle clubs and associations including the NRA and the Iron Silhouette Club.

A further object of the present invention is to provide a novel and improved target assembly which uniquely presents a group of fixed bulls-eye targets above a swingable, self-resetting silhouette target.

SUMMARY OF INVENTION

In summary, the present invention is a target assembly including both a fixed target and a swingable, self resetting target preferably mounted below the former. In the preferred embodiment, the swingable target is pivotally suspended from a cross-member mounted to and between two posts, with the fixed target resting on the cross-member with its opposite sides held within the posts. Additionally, in the preferred embodiment, the movable target is positioned on the cross-member by spacer sleeves received on the cross-member on opposite sides of the movable target, and the sleeves also serve to protect the fixed target from bullets deflecting off the movable target. The posts are mounted on a simple but stable base assembly and the entire assembly may be easily and quickly disassembled by hand and nested into a compact unit for storage or portability. The target assembly of the present invention will accommodate regulation targets used in tournaments and competitions conducted under the official regulations of rifle clubs and associations.

DRAWING

Other objects and advantages of the present invention will become apparent from the following more detailed description of the attached drawing in which FIG. 1 is a perspective view of a portable target assembly constituting a perferred embodiment of the present invention and shown in fully assembled condition.

DETAILED DESCRIPTION

Referring now to the attached drawing, there is shown for illustrative purposes only a target assembly representing a preferred embodiment of the present invention. The target assembly includes a base assembly including an elongated horizontally extending inverted steel channel 10 and a plurality of feet 12 also comprised of inverted steel channels extending transversely below the main base channel 10 to which they are affixed by threaded bolts 14 and wing nuts 16; it being understood that the bolts 14 are received through apertures in the main channel and 10 and feet 12. Upstanding from the main base channel 10 at opposite end portions thereof are a pair of vertical posts 18, preferrably in the form of elongated steel angle bars which include arms extending at right angles to each other when viewed in cross section to define vertical channels for a purpose to become clear below. Posts 18 are removably fixed to the main base channel 10 by means of bolts 20, fixed such as by welding to the lower ends of posts 18 and where they project downwardly and extend through apertures in the main base channel 10 and are secured thereto by wing nuts 22.

Extending between and removably secured to the posts 18 is a cross member 24 preferrably in the form of a steel rod whose opposite ends extend through aligned apertures in bearing plates 28 and in posts 18 where the rod is secured by wing nuts 30. Bearing plates 28 are welded to the arms of posts 18.

Pivotally suspended from cross member 24 is a movable target assembly including a hanger 32 having an aperture in the upper end received about cross member 24 for rotation about a horizontal axis coinciding with the longitudinal axis of the cross member 24. Affixed to the lower end of hanger 32 is a target plate 34 preferably one of the silhouette targets which conform to officially sanctioned or approved targets for use in tournament competitions in accordance with the regulations of shooting clubs and associations, for example, the National Rifle Association. The particular target as shown has a silhouette of a bird, however, it should be understood that other silhouettes, for example, a chicken, pig, turkey or ram may be used in accordance with the existing rules of tournament competitions and shooting clubs, etc. In the referred embodiment, the lower end of hanger 32 has a recess 36 in which the target plate 34 is positioned and welded. Additionally, the lower end of the target plate 34 includes a base or flange 38 which extends at right angles to the target plate and is weighted so that target plate 34 will normally hang in a vertical plane under the force of gravity. It will of course be understood when the target 34 is struck by a bullet, the hanger 32 will rotate about cross rod 24. However, the weight of the assembly, including the flange 38, will cause the target plate 34 to reset itself into a vertical plane. Moreover, should the target be swung sufficiently upwardly upon being struck by a bullet, the flange 38 may be engageable with the back of a fixed target to be described below so as to limit the movement of the target plate 34 and to facilitate return to its normal position in a vertical plane.

In the preferred embodiment, the desired position of the moveable target 34 along the cross member 24, is obtained by a plurality of spacer sleeves 40 which are removably received about the cross rod 24 on opposite sides of the hanger 32. In the preferred embodiment, the spacer sleeves may be steel pipes whose inner ends extend adjacent to the hanger 32 and whose outer ends extend to bearing plates 28. The outside diameter of the sleeves 40 is made sufficiently great to support the bottom of a fixed target to be described below and also to deflect bullets striking the movable target away from the fixed target.

Located above the movable target 34 is a fixed target which in the preferred embodiment includes a rectangular backing board formed, for example, from pressed board such as MASONITE, and a plurality of bulls-eye targets 42 which may be printed on a sheet fixed to the backing 44. The bulls-eye targets, like the movable targets, are in accordance with official bulls-eye targets used in tournament competition and sanctioned by shooting clubs and associations such as the NRA. In the specific embodiment shown, nine bulls-eye targets are in fixed position above the movable target 34. The backing 44 of the fixed target has its opposite side edges received in the channels of posts 18 with the bottom of the backing member resting on the spacer sleeves 40. Therefore no positive fasteners are required in order to position the backing member 44 in the proper fixed position above the movable target 34. Backing 44 is easily positioned on spacers 40 by sliding the backing vertically downwardly in the channels of post 18. It will be obvious that removal of the backing 44 is achieved by sliding it upwardly out of the channels of post 18.

It will thus be seen that the target assembly of the present invention allows a shooter to practice for official competition or tournaments because it utilizes regulation fixed and movable targets while also presenting them to the shooter at the same time, whereby the shooter may fire an entire round before it is necessary to replace the targets. It will also be readily seen that the target assembly of the present invention may be quickly and easily disassembled by hand without the aid of any tools for storage or transportation purposes. To accomplish this, fixed target 44 is simply slid upwardly out of the post 18 and then the wing nuts 30 are loosened to remove the cross rod and spacer sleeves 40 from the posts 18 which then are detached from the base channel 10 by removing wing nuts 22. Wing nuts 16 may then be removed to disassemble feet 12 from the main channel 10. The feet 12 may be nested together with the sleeves 40 and cross member 24 into the posts 18 which may also be nested into the base channel 10 to provide a very compact structure.

In one preferred embodiment, all of the parts of the portable assembly, with the exception of the fired target, are made from steel members. The main base channel 10 may have a length of 1′ 6″ and a width of 2″, while the feet 12 have a length of 8″ and a width of 1″. Posts 18 may have a length of 1′ 2″ with the width of the arms being 1¼″. The length of the steel spacer pipes 40, may be 6″ while having a ½″ inside diameter and an outside diameter of at least 1″ and perhaps greater in order to provide a sufficient shield for protecting the fixed target from bullets which deflect off the movable target as stated above.

The target plate of the movable target may be made from ¼″ steel plates and with the length of the hanger 32 being approximately 6″. From a commercial standpoint, the target assembly may be provided with a set of four steel silhouette movable targets including hangers which will weigh about 4.2 lbs., and a pressed board backing 44 which will weigh about 2 lbs. The total weight of the assembly, without the targets, is about 10.8 lbs. so that the total weight with the targets will be about 18 lbs. It will thus be seen that the target assembly of the present invention, due to its weight, size and construction, is extremely portable and yet is highly useful to the shooter particularly in practicing for official tournaments.

I claim:

1. A target assembly comprising in combination; a base, a pair of posts mounted on the base in horizontally spaced relationship; a cross-member extending between and mounted to the posts, a fixed target removably mounted in fixed position above the cross-member a movable target located between said posts and suspended from the cross-member for rotation relative thereto, a pair of spacer sleeves mounted on said cross-member on opposite sides of the movable target for positioning the movable target along the cross-member, said sleeves also being constructed and dimensioned to deflect bullets striking the movable target away from the fixed target, and wherein said fixed target rests on said sleeves.

2. A target assembly defined in claim 1 wherein said posts define elongated channels removably receiving said fixed target which is slidable in the channels during installation or removal.

3. The target assembly defined in claim 2 wherein said base includes an elongated inverted generally U shaped base channel and said posts, cross-member and sleeves when disassembled may be nested in the base channel.

4. The target assembly defined in claim 2 wherein there is included a plurality of bolt and nut type fastening means removably securing said cross-member to said posts and said posts to said base.

5. The target assembly defined in claim 4 wherein said cross member has on its opposite ends respectively threaded studs received through apertures in said posts and nuts received on said studs outwardly of said posts, and said posts have on their lower ends respectively threaded studs extending through apertures in said base and nuts received on said studs of the posts and securing the posts to the base.

6. The target assembly defined in claim 2 wherein said movable target includes a hanger rotatably mounted on said cross member and a target plate fixed to the hanger such that it normally lies in a vertical plane to which it will automatically return by itself after being struck by a bullet.

7. The target assembly in claim 6 wherein said target plate is made from steel and has the silhouette of an animal, said fixed target includes a pressed board backing and sheet material on said backing and including a plurality of bulls-eye targets.

8. The target assembly defined in claim 1 wherein said movable target includes a hanger rotatably mounted on said cross member and a target plate fixed to the hanger such that it normally lies in a vertical plane to which it will automatically return by itself after being struck by a bullet.

9. A portable target assembly comprising in combination a support structure, a group of fixed bulls-eye targets mounted on a backing member which is removably supported on said structure, a swingable self-resetting target pivotally suspended from said structure below said bulls-eye targets, and wherein said swingable target is removable from said structure and replaceable, and said structure includes several parts that may be assembled or disassembled by hand without the aid of tools, said support structure including means extending generally horizontally and wherein said backing member is removably supported on said means, said means includes a generally horizontally extending cross-member and said swingable target is pivotably suspended from said cross-member.

10. The portable target assembly defined in claim 9 wherein said means includes a pair of spacer sleeves mounted about said cross-member on opposite sides of said swingable target to position said swingable target and to also deflect bullets striking said swingable target.

11. The portable target assembly defined in claim 10 wherein said swingable target includes a hanger mounted to the cross-member and a steel target plate fixed to the hanger such that it normally hangs in a vertical plane.

12. The portable target assembly defined in claim 9 wherein said swingable target includes a hanger pivotally mounted to the structure to be swingable about a horizontal axis, a target plate fixed to the hanger and a flange fixed to the bottom of the target plate such that the target plate normally lies in a vertical plane, and wherein said flange is engageable with said fixed target to act as a stop when the target plate is swung when hit by a bullet.

13. The portable target assembly defined in claim 10 wherein said support structure includes vertical posts having elongated vertical channels, and said backing member is slidably received in said channels.

14. A portable target assembly comprising in combination a support structure including a pair of horizontally spaced posts having a pair of vertical channels, a cross member fixed to and extending between said posts, a plurality of spacer sleeves received about said cross-member, a swingable target pivotally suspended from the cross-member between said spacer sleeves, and a fixed target slidably received in said channels while resting on said spacer sleeves above said swingable target.

15. The portable target assembly defined in claim 14 wherein said swingable target includes a hanger pivotally mounted to the cross-member to be swingable about a horizontal axis, a target plate fixed to the hanger and a flange fixed to the bottom of the target plate such that the target plate normally lies in a vertical plane, and wherein said flange is engageable with said fixed target to act as a stop when the target plate is swung when hit by a bullet.

16. A target assembly comprising in combination; a base, a pair of posts mounted on the base in horizontally spaced relationship; a cross-member extending between and mounted to the posts, a fixed target removably mounted in fixed position above the cross-member, a movable target located between said posts and suspended from the cross member for rotation relative thereto, and wherein said movable target includes a hanger rotatably mounted on said cross member and a target plate fixed to the hanger such that it normally lies in a vertical plane to which it will automatically return by itself after being struck by a bullet, and wherein said target plate has at its bottom a stop engageable with the fixed target when struck by a bullet.

17. The target assembly defined in claim 16 wherein said stop is weighted to bias the target plate to normally lie in a vertical plane.

18. A target assembly comprising in combination a fixed target, a movable target located below the fixed target, and a support structure including means extending in a generally horizontal direction with the fixed target removably supported on said means, said means also serving to locate said movable target and further including means pivotally suspending said movable target.

19. A portable target assembly comprising in combination, a base, a pair of horizontally spaced posts removably supported on said base, a cross member extending between and removably supported by said posts above said base, a movable target movably mounted on said cross member, at least two spacer sleeves located about said cross member on opposite sides of said movable target, and wherein said posts have means for removably receiving a fixed target to be supported on said sleeves in fixed position.

* * * * *